US008929785B1

(12) United States Patent
Roetker et al.

(10) Patent No.: US 8,929,785 B1
(45) Date of Patent: Jan. 6, 2015

(54) ENDLESS FLEXIBLE MEMBERS FOR IMAGING DEVICES

(71) Applicant: Xerox Corporation, Norwalk, CT (US)

(72) Inventors: Michael S Roetker, Webster, NY (US); Francisco J Lopez, Rochester, NY (US); Kyle B Tallman, Farmington, NY (US); Jonathan H Herko, Walworth, NY (US); David W Martin, Walworth, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/034,588

(22) Filed: Sep. 24, 2013

Related U.S. Application Data

(63) Continuation-in-part of application No. 13/019,305, filed on Feb. 1, 2011, now Pat. No. 8,543,043.

(51) Int. Cl.
*G03G 15/16* (2006.01)

(52) U.S. Cl.
CPC ..... *G03G 15/1685* (2013.01)
USPC ..... 399/303; 399/302; 399/313; 430/125.32

(58) Field of Classification Search
USPC ..... 399/303, 302, 308, 313, 329; 430/124.3, 124.32, 124.33, 124.38, 430/125.3, 125.32; 252/500, 502; 264/299
See application file for complete search history.

(56) References Cited

U.S. PATENT DOCUMENTS

| | | | | |
|---|---|---|---|---|
| 4,758,486 | A | 7/1988 | Yamazaki et al. | |
| 5,148,224 | A | 9/1992 | Yamada et al. | |
| 5,561,032 | A | 10/1996 | Vandenabeele | |
| 5,778,295 | A | 7/1998 | Chen et al. | |
| 5,903,808 | A | 5/1999 | Takizawa et al. | |
| 6,044,243 | A | 3/2000 | Hara | |
| 7,026,097 | B2 * | 4/2006 | Hoshi et al. | 430/281.1 |
| 7,139,519 | B2 | 11/2006 | Darcy et al. | |
| 7,410,548 | B2 | 8/2008 | Darcy et al. | |
| 7,645,520 | B2 | 1/2010 | Miyamoto | |
| 7,677,848 | B2 | 3/2010 | Herko et al. | |
| 7,801,455 | B2 | 9/2010 | Solcz et al. | |
| 2003/0188653 | A1 * | 10/2003 | Yanaka | 101/453 |
| 2009/0324304 | A1 | 12/2009 | DeHollander et al. | |
| 2010/0021216 | A1 | 1/2010 | Sawai | |
| 2010/0239335 | A1 | 9/2010 | Sawai | |
| 2010/0279214 | A1 | 11/2010 | Wu | |
| 2011/0211883 | A1 | 9/2011 | Ferrar et al. | |
| 2012/0009371 | A1 | 1/2012 | Pietrantoni et al. | |
| 2012/0049124 | A1 | 3/2012 | Wu et al. | |

* cited by examiner

*Primary Examiner* — Sophia S Chen
(74) *Attorney, Agent, or Firm* — MDIP LLC

(57) ABSTRACT

Flexible members for use in imaging devices contain a non-ionic surfactant and a fluorinated surfactant.

20 Claims, No Drawings

ENDLESS FLEXIBLE MEMBERS FOR IMAGING DEVICES

FIELD

A novel flexible transfer member, such as, an intermediate transfer belt (ITB), such as, an endless belt having an annular main body, for use in an electrophotographic imaging device is provided. The imaging device produces a fixed toner image on a recording medium.

BACKGROUND

In the electrophotographic imaging arts, an image forming apparatus forms a static latent image by exposure of a surface of a charged photosensitive body to patterns of light, that static latent image is developed to form a toner image, and finally, the toner image is transferred to a recording medium at a predetermined transfer position, thereby forming an image thereon.

One such image forming apparatus employs, in the process of image formation and development, an endless belt that is stretched around support rolls, and circulates and moves as a unit, carrying the formed toner image to a transfer position. Alternatively, the endless belt operates as a unit that transfers the recording medium to the transfer position.

In an image forming apparatus that forms a color image, because toner images of individual different colors are superimposed on one another, an endless belt can be used as a unit that carries the toner images of different color which are sequentially applied or received in building the final composite color image. An endless belt also can be used as a unit for transferring a recording medium that sequentially receives toner images of different color. See, for example, U.S. Pat. No. 7,677,848 and U.S. Publ. No. 20100279217, herein incorporated by reference in entirety.

Image forming apparatus with high output speed as well as high endurance capable of withstanding, for example, temperature variation and high volume output, are desirable. Hence, materials to enhance ITB performance and preparation are needed.

Endless flexible belts can be made by producing a film on or attached to a mold, mandrel or form. A film-forming solution or composition is applied to the form by, for example, dipping, spraying or other known method, and the solution or film-forming composition can be dispersed or distributed to form a thin film, for example, by centrifugation over the inner wall of a hollow form, for example, a cylindrical form.

When using such molding methods, the film must be separated from the molding form, and preferably with minimal stress, deformation, damage and the like to the film. Moreover, it is desirable that the film be removed easily from the molding form.

In the electrophotographic arts, it also is beneficial, if not necessary, for a member surface that carries a charge and a latent image to be regular with minimal imperfections, such as, pits, valleys, indentations, waves, wrinkles, dimples and the like, an erose surface is not beneficial if maximal image fidelity is desired.

SUMMARY

According to aspects disclosed herein, there is provided a film-forming composition for making flexible transfer members for use in electrophotography, such as, a flexible image transfer member, such as, an intermediate transfer belt (ITB), wherein a coating solution comprises a non-ionic surfactant that facilitates removal of the formed film from a mold, mandrel, form and the like, and can serve also as a leveling agent that facilitates dispersal of the solution on the mold, mandrel, form or structure. The non-ionic surfactant can comprise longer aliphatic chains.

An embodiment comprises a film-forming composition, such as, a coating solution for making a flexible image transfer member, such as, an intermediate transfer belt (ITB), comprising a fluorinated surfactant that reduces solution surface tension resulting in a film with low surface energy. The fluorinated surfactant can comprise longer aliphatic chains or polymeric chains.

In another embodiment, a film-forming composition can comprise a non-ionic surfactant of interest and a fluorinated surfactant of interest.

Another disclosed embodiment comprises an imaging or printing device comprising a film comprising a non-ionic surfactant, a fluorinated polymeric surfactant or both.

DETAILED DESCRIPTION

As used herein, the term, "electrophotographic," or grammatic versions thereof, is used interchangeably with the term, "xerographic." In some embodiments, such as, in the case of forming a color image, often, individual colors of an image are applied sequentially. Thus, a, "partial image," is one which is composed of one or more colors prior to application of the last of the colors to yield the final or composite color image. "Flexible," is meant to indicate ready deformability, such as observed in a belt, web, film and the like, that, for example, are adaptable to operate with and for use with, for example, rollers.

For the purposes of the instant disclosure, "about," is meant to indicate a deviation of no more than 20% of a stated value or a mean value. Other equivalent terms include, "substantial" and "essential," or grammatic forms thereof.

In some electrophotographic reproducing or imaging devices, including, for example, a digital copier, an image-on-image copier, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, for example, which may be present as an integral component of an imaging device or as a replaceable component or module of an imaging device, and that latent image is rendered visible using electroscopic, finely divided, colored or pigmented particles, or toner. The imaging device component can be used in electrophotographic (xerographic) imaging processes and devices. Examples of flexible components of imaging devices include flexible transfer members.

A flexible imaging member can comprise an intermediate transfer member, such as, an intermediate transfer belt (ITB), a fuser belt, a pressure belt, a transfuse belt, a transport belt, a developer belt and the like. Such belts can comprise a support layer, and optionally, one or more layers of particular function.

Hence, such transfer members can be present in an electrophotographic image forming device or printing device. In the case of an ITB, a photoreceptor is electrostatically charged and then is exposed to a pattern of activating electromagnetic radiation, such as, light, which selectively dissipates the charge in the illuminated areas of the imaging device component while leaving behind an electrostatic latent image in the non-illuminated areas. The electrostatic latent image then is developed at one or more developing stations to form a visible image or a partial image, by depositing finely divided electroscopic colored, dyed or pigmented particles, or toner, for example, from a developer composition, on the surface of the imaging component. The resulting visible image on the photoreceptor is transferred to an ITB for transfer to a receiving member or for further developing of the image, such as, building additional colors on successive registered partial images. The final image then is transferred to a receiving member, such as, a paper, a cloth, a polymer, a plastic, a metal and so on, which can be presented in any of a variety of forms, such as, a flat surface, a sheet or a curved surface. The transferred particles are fixed or fused to the receiving member by any of a variety of means, such as, by exposure to elevated temperature and/or elevated pressure.

It can be desirable to minimize transferring dry toner carrier or liquid carrier to the receiving member, that is, for example, a paper. Therefore, it can be advantageous to transfer the developed image on a photoreceptor to an intermediate transfer web, belt, roll or member, and subsequently to transfer the developed image from the intermediate transfer member to a permanent or ultimate substrate.

An intermediate transfer member also finds use in other multi-imaging systems. In a multi-imaging system, more than one image is developed, that is, a series of partial images. Each image is formed on the photoreceptor, is developed at individual stations and is transferred to an intermediate transfer member. Each of the images may be formed on the photoreceptor, developed sequentially and then transferred to the intermediate transfer member or each image may be formed on the photoreceptor developed and transferred in register to the intermediate transfer member. See for example, U.S. Pat. Nos. 5,409,557; 5,119,140; and 5,099,286, the contents of which are incorporated herein by reference in entirety.

To obtain quality image transfer, that is, to minimize image shear, the displacement of a transfer member due to disturbance during transfer member driving can be reduced by limiting the thickness of the support or substrate, for example, to about 50 μm. Thus, the thickness of the substrate or support can be from about 50 μm to about 150 μm or from 70 μm to about 100 μm.

The support, substrate or layer can be made of known materials, such as, a synthetic material, such as, a resin, a fibrous material and so on, and combinations thereof, see, for example, "The Encyclopedia of Engineering Materials and Processes," Reinhold Publishing Corporation, Chapman and Hall, Ltd., London, page 863, 1963, the entire disclosure of which is hereby incorporated herein by reference.

Suitable synthetic materials, including, liquid crystal polymers, graphites, nylons, rayons, polyesters, Kevlar (aromatic polyamide obtainable from E.I. dupont de Nemours), Nomax, Peek (polyethoxyether ketones available from ICI), polyvinyl fluorides (e.g., Tedlar available from E.I. dupont de Nemours), polyvinylidene fluorides (e.g., Kynar 7201, Kynar 301F and Kynar 202, all available from Pennwalt Co.), polytetrafluoroethylenes (e.g. Teflon, available from E.I. duPont de Nemours & Co.) and other fluorocarbon polymers; Viton B-50 (blend of vinylidene fluoride and hexafluoropropylene copolymer); Viton GF (blend of vinylidene fluoride, hexafluoropropylene and tetrafluoroethylene terpolymer), polybutadienes and copolymers with styrene, vinyl/toluenes, acrylates, polyethylenes, polypropylenes, polyimides, polyethylpentenes, polyphenylene sulfides, polystyrene and acrylonitrile copolymers, polyvinylchloride and polyvinyl acetate copolymers and terpolymers, silicones, acrylics and copolymers, alkyd polymers, amino polymers, cellulosic resins and polymers, epoxy resins and esters, polyamides, phenoxy polymers, phenolic polymers, phenylene oxide polymers, polycarbonates (e.g. Makrolon 5705, available from Bayer Chemical Co., Merlon M39, available from Mobay Chemical Co. and Lexan 145, available from General Electric Co.), polysulfones (e.g. P-3500, available from Union Carbide Corp.), polyesters (e.g. PE-100 and PE-200 available from Goodyear Tire and Rubber Co.), polyarylates, acrylics, polyarylsulfones, polybutylenes, polyether sulfones, polyurethanes, poly(amide-imides) (e.g. A1830 available from AMOCO Chemical Corp.), copolyesters (Kodar Copolyester PETG 6763 available from Eastman Kodak Co.), polyetherimides (e.g. available from General Electric Co.), polyarylethers and the like, and mixtures thereof. Polycarbonate polymers may be made according to methods known in the art, for example, from 2,2-bis(4-hydroxyphenol)propane; 4,4'-dihydroxy-diphenyl-1,1-ethane; 4,4'-dihydroxy-diphenyl-1,1-isobutane; 4,4'-dihydroxy-diphenyl-4-heptane; 4,4'-dihydroxy-diphenyl-2,2-hexane; 4,4'-dihydroxy-triphenyl-2,2,2-ethane; 4,4'-dihydroxy-diphenyl-1,1-cyclohexane; 4,4'-dihydroxy-diphenyl-β,β-decahydronaphthalene; cyclopentane derivatives of 4,4'dihydroxy-diphenyl-β,β-decahydronaphthalene; 4,4'-dihydroxy-diphenyl-sulphone; and the like, or blends and mixtures thereof can be employed. Glass fibers also may be used.

A transfer member or device can have more than one layer. In that event, the first layer, when viewing a cross section of the multilayered transfer member with the surface to which the image is affixed oriented at the top, is the lowest layer or can be the support or substrate of the transfer member, and the last layer added or the most superficial layer (in the cross section depiction is the uppermost or top layer) generally is one having a low surface energy, i.e., material comprising an electrically conductive agent dispersed thereon having a contact angle of not less than about 70° or at least about 70° with respect to a water droplet, as represented by wettability by water. The term, "wettability by water," as used herein is meant to indicate the angle of contact of a material constituting the surface layer of a specimen with respect to a water droplet thereon.

Electrical property regulating materials can be added to the substrate or to a layer superficial thereto to regulate electrical properties, such as, surface and bulk resistivity, dielectric constant and charge dissipation. In general, electrical property regulating materials can be selected based on the desired resistivity of the film. High volume fractions or loadings of the electrical property regulating materials can be used so that the number of conductive pathways is always well above the percolation threshold, thereby avoiding extreme variations in resistivity. The percolation threshold of a composition is a volume concentration of dispersed phase below which there is so little particle to particle contact that the connected regions are small. At higher concentrations than the percolation threshold, the connected regions are large enough to traverse the volume of the film. Scher et al., J Chem Phys, 53(9)3759-3761, 1970, discuss the effects of density in percolation processes.

Particle shape of the electrical property regulating material can influence volume loading. Volume loading can depend on whether the particles are, for example, spherical, round, irregular, spheroidal, spongy, angular or in the form of flakes or leaves. Particles having a high aspect ratio do not require as high a loading as particles having a relatively lower aspect ratio. Particles which have relatively high aspect ratios include flakes and leaves. Particles which have a relatively lower aspect ratio are spherical and round particles.

The percolation threshold is practically within a range of a few volume % depending on the aspect ratio of the loadent. For any particular particle resistivity, the resistivity of the coated film can be varied over about one order of magnitude by changing the volume fraction of the resistive particles in the layer. The variation in volume loading enables fine tuning of resistivity.

The resistivity varies approximately linearly to the bulk resistivity of the individual particles and the volume fraction of the particles in the support or layer. The two parameters can be selected independently. For any particular particle resistivity, the resistivity of the member can be varied over roughly an order of magnitude by changing the volume fraction of the particles. The bulk resistivity of the particles preferably is chosen to be up to three orders of magnitude lower than the bulk resistivity desired in the member. When the particles are mixed with the support or layer in an amount above the percolation threshold, the resistivity of the resulting reinforcing member can decrease in a manner proportional to the increased loading. Fine tuning of the final resistivity may be controlled on the basis of that proportional change in loading.

The bulk resistivity of a material is an intrinsic property of the material and can be determined from a sample of uniform cross section. The bulk resistivity is the resistance of such a sample multiplied by the cross sectional area divided by the length of the sample. The bulk resistivity can vary somewhat with the applied voltage.

The surface or sheet resistivity (expressed as ohms/square, Ω/□) is not an intrinsic property of a material because that metric depends on material thickness and contamination of the material surface, for example, with condensed moisture. When surface effects are negligible and bulk resistivity is isotropic, the surface resistivity is the bulk resistivity divided by the member thickness. The surface resistivity of a film can be measured without knowing the film thickness by measuring the resistance between two parallel contacts placed on the film surface. When measuring surface resistivity using parallel contacts, one uses contact lengths several times longer than the contact gap so that end effects do not cause significant error. The surface resistivity is the measured resistance multiplied by the contact length to gap ratio.

Particles can be chosen which have a bulk resistivity slightly lower than the desired bulk resistivity of the resulting member. The electrical property regulating materials include, but are not limited to, pigments, quaternary ammonium salts, carbons, dyes, conductive polymers and the like. Electrical property regulating materials may be added in amounts ranging from about 1% by weight to about 50% by weight of the total weight of the support or layer or from about 5% to about 35% by weight of the total weight of the support or layer.

Thus, for example, carbon black systems can be used to make a layer or layers conductive. That can be accomplished by using more than one variety of carbon black, that is, carbon blacks with different, for example, particle geometry, resistivity, chemistry, surface area and/or size. Also, one variety of carbon black or more than one variety of carbon black can be used along with other non-carbon black conductive fillers.

An example of using more than one variety of carbon black, each having at least one different characteristic from the other carbon black, includes mixing a structured black, such as, VULCAN® XC72, having a steep resistivity slope, with a low structure carbon black, such as, REGAL® 250R, having lower resistivity at increased filler loadings. The desired state is a combination of the two varieties of carbon black which yields a balanced controlled conductivity at relatively low levels of filler loading, which can improve mechanical properties.

Another example of mixing carbon blacks comprises a carbon black or graphite having a particle shape of a sphere, flake, platelet, fiber, whisker or rectangle used in combination with a carbon black or graphite with a different particle shape, to obtain good filler packing and thus, good conductivity. For example, a carbon black or graphite having a spherical shape can be used with a carbon black or graphite having a platelet shape. The ratio of carbon black or graphite fibers to spheres can be about 3:1.

Similarly, by use of relatively small particle size carbon blacks or graphites with relatively large particle size carbon blacks or graphite, the smaller particles can orient in the packing void areas of the polymer substrate to improve particle contact. As an example, a carbon black having a relatively large particle size of from about 1 μm to about 100 μm or from about 5 μm to about 10 μm can be used with a carbon black having a particle size of from about 0.1 μm to about 1 μm or from about 0.05 μm to about 0.1 μm.

In another embodiment, a mixture of carbon black can comprise a first carbon black having a BET surface area of from about 30 $m^2/g$ to about 700 $m^2/g$ and a second carbon black having a BET surface area of from about 150 $m^2/g$ to about 650 $m^2/g$.

Also, combinations of resistivity can be used to yield a shallow resistivity change with filler loading. For example, a carbon black or other filler having a resistivity of about $10^{-1}$ to about $10^3$ ohms-cm, or about $10^{-1}$ to about $10^2$ ohms-cm used in combination with a carbon black or other filler having a resistivity of from about $10^3$ to about $10^7$ ohms-cm.

Other fillers, in addition to carbon blacks, can be added to the polymer, resin or film-forming composition and dispersed therein. Suitable fillers include metal oxides, such as, magnesium oxide, tin oxide, zinc oxide, aluminum oxide, zirconium oxide, barium oxide, barium titanate, beryllium oxide, thorium oxide, silicon oxide, titanium dioxide and the like; nitrides such as silicon nitride, boron nitride, and the like; carbides such as titanium carbide, tungsten carbide, boron carbide, silicon carbide, and the like; and composite metal oxides such as zircon, spinel ($MgO—Al_2O_3$), mullite ($3Al_2O_3.2SiO_2$), sillimanite ($Al_2O_3.SiO_2$) and the like; mica; and combinations thereof. Optional fillers can present in the polymer/mixed carbon black coating in an amount of from about 20% to about 75% by weight of total solids, or from about 40% to about 60% by weight of total solids.

The resistivity of the coating layer can be from about $10^7$Ω/□ to about $10^{13}$Ω/□, from about $10^8$Ω/□ to about $10^{12}$Ω/□ or from about $10^9$Ω/□ to about $10^{11}$Ω/□.

In another embodiment, a thin insulating layer of the polymer/carbon black mixture is used and has a dielectric thickness of from about 1 μm to about 10 μm or from about 4 μm to about 7 μm.

The hardness of the polymer/carbon black mixture coating can be less than about 85 Shore A, from about 45 Shore A to about 65 Shore A, or from about 50 Shore A to about 60 Shore A.

In another embodiment, the surface can have a water contact angle of at least about 60°, at least about 70°, at least about 75°, at least about 90°, or at least about 95°.

Transfer members can be prepared using methods known in the art. For example, metals, synthetic materials or other film-forming compositions as taught herein or as known in the art to form the first layer of the member can be electrodeposited on a mandrel, mold or form, or on the interior surface of a sleeve electrode, mandrel, mold or form as known in the art. Examples of such methods are described in U.S. Pat. Nos. 4,747,992 and 4,952,293, which are hereby incorporated herein by reference. Other techniques for applying materials include liquid and dry powder spray coating, flow coating, dip coating, wire wound rod coating, fluidized bed coating, powder coating, electrostatic spraying, sonic spraying, blade coating and the like. If a coating is applied by spraying, spraying can be assisted mechanically and/or electrically, such as, by electrostatic spraying.

In such cases where a film-forming solution or composition is applied to a form, a mandrel, a mold and the like, removal of the formed film intact and with minimal damage, with little difficulty or intervention, or both are desirable. Inclusion of a non-ionic surfactant in the solution added directly to the form, mandrel, mold and the like facilitates or enhances such subsequent facile removal of the dried and/or cured film therefrom. In another embodiment, a non-ionic surfactant also enhances spreading and leveling of the solution on the mold, form, mandrel and the like.

Non-ionic surfactants are known in the art and are available commercially. Non-ionic surfactants comprising an aliphatic chain can be used. Aliphatic chains of longer length, such as, for example, greater than 8 carbons, greater than 10 carbons, greater than 12 carbons and so on, also can be used. Examples include 2,4,7,9-tetramethyl-5-decyne-4,7-diol ethoxylate; 8-methyl-1-nonanol propoxylated-block-ethoxylate; a Brij, which are fatty alcohol ethers; a polyethylene-block-poly (ethylene glycol) (Sigma-Aldrich); a Dowfax surfactant, polypropylene glycols and copolymers manufactured by Dow; a Myrj, which are fatty acid ethoxylates, a Synperonic PE, which are ethylene oxide-propylene oxide block copolymers (Croda Chemicals); a BIO-SOFT®, fatty alcohol, alcohol or fatty alkyl ethoxylates; a MAKON®, decyl alcohol, tridecyl alcohol or nonlyl phenol ethoxylates; a StepFac, nonylphenol phosphate esters, a POLYSTEP®, which are alkylphenol ethoxylates (Stepan Co.); and the like, which are compatible with and not detrimental to the intended use of the layer and resulting member.

Thus, one or more non-ionic surfactants are added to the film-forming solution or composition that is applied directly to the mold, form, mandrel and so on, and are suspended or dissolved therein as known in the art. The total amount of a non-ionic surfactant that can be used in the solution or composition for making the first layer is present in an amount from about 0.0004% to about 25%, from about 0.0005% to about 20%, from about 0.0006% to about 17.5%, from about 0.0007% to about 15%, from about 0.0008% to about 12.5%, from about 0.0009% to about 11%, from about 0.001% to about 10%, from about 0.001% to about 9%, from about 0.001% to about 8%, from about 0.001% to about 7%, from about 0.001% to about 6%, from about 0.001% to about 5%, from about 0.001% to about 4%, from about 0.001% to about 3% by weight of the film-forming solution or composition. The film is obtained by drying, heating and the like, as taught herein or as known in the art.

For all layers or the last added and most superficial layer, where a regular and minimally erose surface is desirable, a fluorinated surfactant, such as one comprising a polymer, added to the film-forming solution reduces surface tension and yields a film with low surface energy and enhanced uniformity, that is, reduces the amount of pitting, undulations, irregularities and the like that can contribute to an irregular surface.

Fluorinated surfactants are known and available commercially. Examples include a Novec, some of which are non-ionic polymeric fluorosurfactants, available from 3M; a Flexiwet, which can be anionic, cationic or amphoteric, from ICT, Inc.; a FluorN, which are polymeric surfactants available from Cytonix; and the like, which are compatible with and not detrimental to the intended use of the layer and resulting member.

Thus, one or more fluorinated surfactants are added to all of the film-forming solutions or compositions or to that which is applied last to the member under construction and are suspended or dissolved therein as known in the art. The total amount of fluorinated surfactant that is used in the solution or composition for making the layer or layers is present in an amount from about 0.0001% to about 10%, from about 0.00015% to about 9.5%, from about 0.0002% to about 9%, from about 0.000225% to about 8.5%, from about 0.00025% to about 8%, from about 0.000275% to about 7.5%, from about 0.0003% to about 7%, from about 0.0003% to about 6.5%, from about 0.0003% to about 6%, from about 0.0003% to about 5.5%, from about 0.0003% to about 5%, from about 0.0003% to about 4.5%, from about 0.0003% to about 4%, from about 0.0003% to about 3.5%, from about 0.0003% to about 3% by weight of the film-forming solution or composition. The film is obtained by drying, heating and the like, as taught herein or as known in the art.

In some embodiments, for example, where the film comprises a single layer, which may be polyfunctional, both a non-ionic surfactant and a fluorinated surfactant in the amounts recited above when used individually are each added to the film-forming solution, incorporated into the mixture and then applied to the mold, mandrel, form and the like using an applying mode taught herein or as known in the art.

All components of a coating solution contribute to the total surface tension. Thus, a solvent also can contribute to a higher surface tension. Solvents which are used commonly because of, for example, a higher boiling point and/or better solubility of certain polymers include dimethylacetamide, dimethylformamide and methylpyrrolidone. However, those three solvents have higher surface tension values. The two surfactants of interest enable continued use of such solvents with the beneficial properties thereof, such as, higher boiling point and better solubility of certain polymers, without the detriment of contributing to a high surface tension.

Various aspects of the embodiments of interest now will be exemplified in the following non-limiting examples.

EXAMPLES

Comparative Example 1

A 20% phenoxy resin, PKHH-XLV (InChem Corp.), in dimethylformamide (DMF) (10 g) was coated on a stainless steel belt with a 10-mil Bird bar and dried at 65° C. for 30 minutes, at 145° C. for 30 minutes and then at 180° C. for 30 minutes.

The film could not be released from the stainless steel mold. Moreover, the film surface showed considerable wrinkling.

Example 1

A 20% phenoxy resin, PKHH-XLV, in DMF (10 g) was mixed with 0.01 g of non-ionic surfactant, StepFac-8171 (Stepan). After roll mixing for 30 minutes, the solution was coated on a stainless steel belt with a 10-mil Bird bar and dried at 65° C. for 30 minutes, at 145° C. for 30 minutes and then at 180° C. for 30 minutes.

The film was released readily from the stainless steel mold. However, the film surface showed a degree of wrinkling.

Example 2

A 20% phenoxy resin, PKHH-XLV, in DMF (10 g) was mixed with 0.01 g of non-ionic surfactant, StepFac-8171 (Stepan), and 2 mg of Novec FC-4432 (3M). After roll mixing for 30 minutes, the solution was coated on a stainless steel belt with a 10-mil Bird bar and dried at 65° C. for 30 minutes, at 145° C. for 30 minutes and then at 180° C. for 30 minutes.

The film was released readily from the stainless steel mold. Moreover, the film had very smooth and shiny surface.

Example 3

The above three films were analyzed by measuring surface roughness and water contact angle using materials and methods known in the art.

The surface roughness data showed the film of Example 1 had a peak-valley value of about 1.08 μm and the film of Example 2 had a surface roughness of about 80 nm, a noticeable improvement by employing the Novec surfactant.

The surface energy was measured by water contact angle and formamide contact angle practicing materials and methods known in the art. The results are summarized in the table below. It can be seen that the film of Example 2 containing the Novec surfactant had much lower surface energy.

| Sample ID | Dispersive (dyne/cm) | Polar (dyne/cm) | Total (dyne/cm) | |
|---|---|---|---|---|
| Example 1 | 27.5 | 18.7 | 46.2 | Harmonic Mean |
| Example 1 | 32.8 | 12.2 | 45.0 | Geometric Mean |
| Example 2 | 2.6 | 18.4 | 21.0 | Harmonic Mean |
| Example 2 | 1.5 | 13.3 | 14.8 | Geometric Mean |

The film of Example 2 had a water contact angle of about 97.5° and the film of Example 1 had water contact angle of about 65°.

Example 4

ITB Preparation

Ten grams of 20% phenoxy resin, PKHH-XLV, in DMF was mixed with 1.95 g a carbon black dispersion solution (solid content 18.38%), 0.01 g of non-ionic surfactant Step-Fac-8171 (Stepan) and 2 mg of fluorosurfactant FC-4432 from 3M. After roll mixing for 30 minutes, the solution was coated on a stainless steel mold with a 10-mil Bird bar and dried at 65° C. for 30 minutes, at 145° C. for 30 minutes and then at 180° C. for 30 minutes.

The resulting ITB was tested practicing materials and methods known in the art, and the surface energy test results are provided in the table below. It can be seen that the resulting ITB has a low surface energy, for example, compare to the data provided in the above for the film of Example 1.

| Dispersive (dyne/cm) | Polar (dyne/cm) | Total (dyne/cm) | |
|---|---|---|---|
| 17.7 | 6.3 | 24.0 | Harmonic Mean |
| 19.5 | 2.0 | 21.5 | Geometric Mean |

The water contact angle averaged about 98.6°, representing a low surface energy of the ITB, as compared, for example, to the water contact angle of the film of Example 1 which did not contain the fluorosurfactant.

The surface resistivity of the ITB film was $9.95\times10^{10}\Omega/\square$.

All references cited herein are herein incorporated by reference in entirety.

It will be appreciated that variants of the above-disclosed and other features and functions, or alternatives thereof, may be combined with other and different systems or applications. Various presently unforeseen or unanticipated alternatives, changes, modifications, variations or improvements subsequently may be made by those skilled in the art to and based on the teachings herein without departing from the spirit and scope of the embodiments, and which are intended to be encompassed by the following claims.

What is claimed is:

1. A flexible transfer member comprising a non-ionic surfactant in an amount from about 0.0004% to about 25% by weight of a film-forming solution and a fluorinated surfactant in an amount from about 0.0001% to about 10% by weight of the film-forming solution.

2. The flexible transfer member of claim 1, comprising plural flexible layers including a first layer and a last layer.

3. The flexible transfer member of claim 2, wherein said first flexible layer comprises said non-ionic surfactant and said last layer comprises said fluorinated surfactant.

4. The flexible transfer member of claim 1, wherein said non-ionic surfactant is present in an amount from about 0.0005% by weight to about 20% by weight.

5. The flexible transfer member of claim 1, wherein said non-ionic surfactant is present in an amount from about 0.0006% by weight to about 17.5% by weight.

6. The flexible transfer member of claim 1, wherein said fluorinated surfactant is present in an amount from about 0.00015% by weight to about 9.5% by weight.

7. The flexible transfer member of claim 1, wherein said fluorinated surfactant is present in an amount from about 0.0002% by weight to about 9% by weight.

8. The flexible transfer member of claim 1, further comprising an electrical property regulating material.

9. The flexible transfer member of claim 8, wherein said material comprises a carbon black.

10. The flexible transfer member of claim 1, wherein said non-ionic surfactant comprises a phosphate ester.

11. The flexible transfer member of claim 1, wherein said non-ionic surfactant comprises a nonylphenol phosphate ester.

12. The flexible transfer member of claim 1, wherein said fluorinated surfactant is nonionic.

13. The flexible transfer member of claim 1, wherein said fluorinated surfactant is polymeric.

14. The flexible transfer member of claim 1, wherein said non-ionic surfactant is present in an amount from about 0.0007% by weight to about 15% by weight.

15. The flexible transfer member of claim 1, wherein said fluorinated surfactant is present in an amount from about 0.000225% by weight to about 8.5% by weight.

16. The flexible transfer member of claim 1, wherein an external surface thereof comprises a water contact angle of at least about 70.

17. The flexible transfer member of claim 1, wherein an external surface thereof comprises a surface resistivity of from about $10^7\Omega/\square$ to about $10^{13}\Omega/\square$.

18. The flexible transfer member of claim 1, wherein an external surface thereof comprises a water contact angle of at least about 70° and a surface resistivity of from about $10^7\Omega/\square$ to about $10^{13}\Omega/\square$.

19. An imaging device comprising the flexible transfer member of claim 1.

20. The imaging device of claim 19, wherein said flexible transfer member comprises a belt.

* * * * *